US008013820B2

(12) United States Patent
Goetz et al.

(10) Patent No.: US 8,013,820 B2
(45) Date of Patent: Sep. 6, 2011

(54) PULSE WIDTH DRIVING METHOD USING MULTIPLE PULSE

(75) Inventors: Howard V. Goetz, Tigard, OR (US); James L. Sanford, Camas, WA (US); Jonathan A. Sachs, Vancouver, WA (US)

(73) Assignee: Compound Photonics Limited, Phoenix, AZ (US)

( * ) Notice: Subject to any disclaimer, the term of this patent is extended or adjusted under 35 U.S.C. 154(b) by 994 days.

(21) Appl. No.: 11/809,417

(22) Filed: Jun. 1, 2007

(65) Prior Publication Data

US 2007/0296663 A1 Dec. 27, 2007

Related U.S. Application Data

(60) Provisional application No. 60/803,752, filed on Jun. 2, 2006.

(51) Int. Cl.
*G09G 3/36* (2006.01)

(52) U.S. Cl. ..... 345/87; 345/94; 359/264

(58) Field of Classification Search ..... 345/87–89, 345/204, 691; 359/242, 264
See application file for complete search history.

(56) References Cited

U.S. PATENT DOCUMENTS

| | | | | |
|---|---|---|---|---|
| 5,140,448 A | | 8/1992 | Bone et al. | |
| 6,008,929 A | * | 12/1999 | Akimoto et al. | 359/264 |
| 6,084,896 A | * | 7/2000 | Ohtomo et al. | 372/38.06 |
| 6,621,615 B2 | * | 9/2003 | Kruschwitz et al. | 359/264 |
| 6,781,737 B2 | * | 8/2004 | Willis | 359/264 |
| 6,798,550 B1 | * | 9/2004 | Wang et al. | 359/245 |
| 6,967,759 B2 | | 11/2005 | Hewlett et al. | 359/242 |
| 2002/0047824 A1 | | 4/2002 | Handschy | |
| 2002/0093477 A1 | | 7/2002 | Wood | |
| 2003/0103046 A1 | | 6/2003 | Rogers | |
| 2004/0196524 A1 | * | 10/2004 | Hughes et al. | 359/244 |
| 2006/0022965 A1 | | 2/2006 | Martin et al. | 345/204 |
| 2006/0066645 A1 | | 3/2006 | Ng | |

OTHER PUBLICATIONS

Supplemental European Search Report for European Application No. 07 79 5667, dated Mar. 12, 2010, 8 pages.

* cited by examiner

*Primary Examiner* — Kimnhung Nguyen
(74) *Attorney, Agent, or Firm* — McKenna Long & Aldridge, LLP.

(57) ABSTRACT

A method, device and computer program are detailed for modulating write light. For a plurality of pixel locations of an electro-optic layer of an optical write valve and across each of a plurality of consecutive frames, a set of pixel data bits is modulated across a first and a second pulse width period of the frame. The first and second pulse width periods, and adjacent pulse periods of sequential frames, are separated from one another by a pulse-off period that is at least equal to a response time of the electro-optic layer during which no bits are modulated. Separately in each frame, write light is output from each of the plurality of pixel locations according to the modulated pixel data bits in the frame. In an embodiment, the set of pixel data bits are modulated by applying a voltage at a pixel location of the electro-optic layer in synchronism with illuminating a light source that illuminates that pixel location.

32 Claims, 6 Drawing Sheets

PULSE WIDTH DRIVING METHOD USING MULTIPLE PULSE

CROSS REFERENCE TO PRIORITY AND RELATED APPLICATIONS

This application claims priority to Provisional U.S. Patent Application No. 60/803,752, filed on Jun. 2, 2006, which is hereby incorporated by reference in its entirety. The subject matter of this application is related to commonly assigned U.S. patent application Ser. No. 11/569,498, filed Nov. 21, 2006, which is also incorporated by reference.

BACKGROUND

Previous methods for modulating the polarization rotation characteristics (and thus the net optical transmission) of a liquid crystal micro display in a projection display system uses electronics integrated into the display to directly control the voltages on the pixel elements. In these micro displays, the nematic liquid crystal, the most commonly used type of LC, responds to the RMS (root mean squared) values of the pixel voltages. In order to achieve gray-scale control of these displays it is necessary to modulate the individual pixel voltages. Generally there are two approaches to implementing this modulation: Analog or Digital.

Analog modulation methods were commonly used with earlier micro displays. However they are poorly suited to very high-density displays due to the small pixel size and difficulty of storing accurate analog voltages. This difficulty often translates into poor device yields and pixel non-uniformity. Because of this, the micro display industry increasingly uses digital modulation methods.

Digital modulation usually takes the form of either pulse width modulation PWM or duty factor modulation DFM. PWM schemes involve applying a voltage pulse to the LCD that is of fixed amplitude and variable width, where typically the width ranges from 0 to the entire frame period, corresponding to gray level from 0 to full-scale. PWM schemes can produce excellent gray-scale results and are inherently monotonic and independent of LC turn on and turn off times. However, they are very complex to implement in actual display systems, they require significant amounts of system memory having very high data rates and they may require a large number of data latches in the pixel if used for color sequential operation. Alternate methods of achieving PWM can reduce the pixel circuit complexity but at the expense of requiring extremely high data rates. In practice, PWM schemes are generally too difficult or expensive for use in micro displays and are not widely encountered.

DFM schemes are the most widely used form of digital LC modulation. In DFM, fixed-amplitude voltage pulses for each gray level bit are applied to the LC. Depending on the particular gray level to be displayed, there are typically several voltage pulses for driving a pixel during the frame time. There can be up to one-half as many pulses as there are gray level bits, with the widths of the individual pulses corresponding to the binary weights of the individual bits. As the name implies, in DFM the total additive durations of the pulses divided by the total frame time determines the duty factor of the voltage. The problem with this scheme is that it does not take into account the finite rise and fall times of the LC and particularly of the fact that the rise and fall times are often different from each other. This causes the actual RMS voltage to differ from the theoretical duty-factor calculated from the voltage alone. More seriously, this error depends on how many sets of rising and falling edges there are, and thus on how many pulses there are, which changes drastically as a function of the desired gray level. The result is that DFM schemes are generally nonmonotonic at a number of gray levels, which is a serious problem. A number of schemes have been developed to attempt to correct this non-monotonic behavior. None of these schemes are fully satisfactory and most require substantial increases in cost, in complexity, and in data rate.

A co-owned application, incorporated by reference and entitled "An optically addressed gray scale electric charge accumulating spatial light modulator," U.S. Provisional Application No. 60/803,747, addresses several of the DFM issues. However, very fast LC switching speeds and pulsed illumination are required. In many display systems, very fast LC switching speeds and pulse illumination are not possible. There is a need for a LC driving method that is less complicated than PWM but overcomes the non monotonic behavior of most DFM driving method and doesn't require extremely fast LC response times.

SUMMARY

In accordance with one embodiment of the invention is a method that, for a plurality of pixel locations of an electro-optic layer of an optical write valve and across each of a plurality of consecutive frames, includes modulating a set of pixel data bits across a first and a second pulse width period of the frame. In the method, the first and second pulse width periods, and adjacent pulse periods of sequential frames, are separated from one another by a pulse-off period that is at least equal to a response time of the electro-optic layer during which no bits are modulated. Further in the method and separately in each frame, write light is output from each of the plurality of pixel locations according to the modulated pixel data bits in the frame.

In accordance with another embodiment of the invention is an optical write valve that includes an electro-optic layer, a backplane defining pixel locations of the electro-optic layer, a light source, and a controller coupled to a memory. The light source is arranged in optical communication with the electro-optic layer. The controller is adapted for each pixel location and across each of a plurality of consecutive frames, to apply a voltage in synchronism with illuminating the light source so as to modulate a set of pixel data bits across a first and a second pulse width period of a frame, where the first and second pulse width periods and adjacent pulse periods of sequential frames, are separated from one another by a pulse-off period that is at least equal to a response time of the electro-optic layer during which no bits are modulated. The electro-optical layer is adapted, separately in each frame, to output write light from each of the pixel locations according to the modulated pixel data bits in the frame.

In accordance with another embodiment of the invention is a computer program embodied on a memory and readable by a computer for performing actions directed to outputting write light. In this embodiment, the actions apply for a plurality of pixel locations of an electro-optic layer of an optical write valve and across each of a plurality of consecutive frames, and the actions include modulating a set of pixel data bits across a first and a second pulse width period of the frame, where the first and second pulse width periods, and adjacent pulse periods of sequential frames, are separated from one another by a pulse-off period that is at least equal to a response time of the electro-optic layer during which no bits are modulated. The actions further include, separately in each frame, outputting write light from each of the plurality of pixel locations according to the modulated pixel data bits in the frame.

These and other aspects of the invention are detailed with more particularity below.

DETAILED DESCRIPTION

Figure 1:
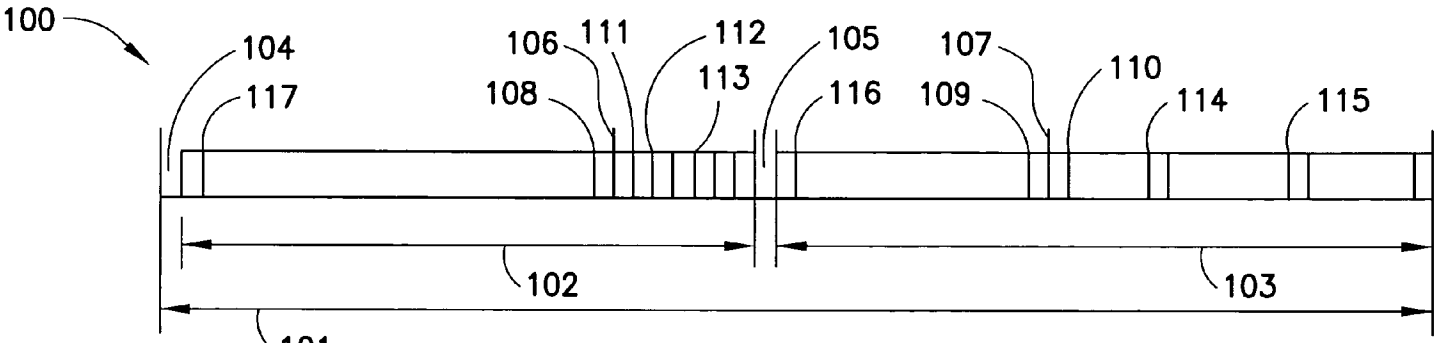
FIG. 1 is a timing diagram showing two pulse width periods with pulse-off periods between them and at the start of the frame during which a liquid crystal layer of a display is depowered.

In many display systems digital driving methods are replacing analog drive schemes. A new digital driving method is disclosed that is particularly applicable to digital active matrix display systems using liquid crystal (LC) technology. The new digital driving method encodes pixel data into two or more pulse-width modulated pulses. The pulses are separated electronically in time to allow for LC turnoff. Even in cases where there is significant difference in LC rise and LC fall response times, the pulse separation provides monotonic electro optic behavior that would not be possible with simpler duty factor modulation DFM drive methods. Multiple pulse-width modulation MPWM allows the data rate of the display system electronics to be significantly reduced compared to single pulse width modulation PWM systems. In order to further reduce the data bandwidth, lower levels of illumination may be used with lower weighted portions of the drive pulses than are used with higher weighted portions of the drive pulses. The variation in the level of incident illumination may be accomplished by pulsing the illumination with variable width, or by varying the amplitude in time, or by a combination of both methods.

In digital light-valve modulation, simple pulse-width modulation would give the best result but is generally too complex to implement. Duty-factor modulation is simpler but its prior art implementations often gives poor results. Below is detailed a variation on pulse-width modulation that works nearly as well as simple pulse-width modulation but is intermediate in difficulty. An important concept underlying this invention is to modulate the write-valve with two variable-width pulses instead of one (as in simple pulse width modulation). As long as the two pulses are separated in time by at least the LC response time, the result can be made to be about as good as simple PWM, but only require about ¼ as much logic and bandwidth to achieve. Embodiments of the invention encompass several techniques involving also modulating the write-light in time and/or amplitude, which further simplifies implementation and improves performance. As will be appreciated from the description below, there is a family of possible choices for how the bits of gray scale information (10 bits used below as a non-limiting example) is to be divided between the pulses (two pulses used below as a non-limiting example), and how the illumination would be managed.

If the LC response time is significantly shorter than the frame period, then some portion of the frame time can be allocated to turning the LC on and off without significantly reducing the display brightness. In such a case this time can be utilized to separate two (or more) pulse-width-modulated pulses such that the LC fully turns off between the pulses. Fully turning off the LC between the pulses guarantees that the rise and fall characteristics of the pulses cannot overlay and so do not interfere with each other. This in turn guarantees that their influence on the modulation of the cell is completely independent of each other, which is a necessary condition for monotonic gray-scale modulation. This modulation mode also makes it much easier to compensate for duty-cycle errors caused by rising and falling edges since (in the two pulse case and for gray-levels above zero) there will always at least be one pair of rising/falling edges, and at most 2 pairs. This is in contrast to the 10-pulse case where there can be as few as 1 pair, and as many as 10. Dividing the total PWM for the frame into two (or more) pulse-width-modulated pulses can substantially reduce the memory and data rates in the display system as compared to single-pulse PWM.

As an example, assume that 10 bit gray level drive is desired. For MPWM using ten gray level bits, the data is split into a first and a second group of 5 bits each with a common starting reference time position between the two groups. Each 5 bit group can be decoded into 31 bits and related times in the frame period. The total number of decoded bits is 62. However, breaking up the 10 bits of data into two separated 5 bit data pulses and splitting the 5 bit data pulse into two groups of 2 and 3 pulse start/end times each allows the number of encoded pulse start/end times to be reduced to 22; 11 time-points for each 5 bit data pulse. This reduces the display system memory requirements and the bandwidth or data rates between the display controller and the display by a factor of approximately 3 in this example.

With the use of multiple pulse width modulated pulses, the memory data rates, the amount of system memory and the number of circuit data latches in the pixel can be reduced. The number of pixel circuit data latches needed is a function of data encoding, display controller to display bandwidth, display format and several other system requirements. The reduction factor of 3 is very important in realizing an economical display system.

It should be also noted that the 10 bit data word can be broken into a 4 bit pulse and 6 bit pulse. The amount of memory is the same as two 5 bit pulses; 22 encoded pulse start/end times. The ten bit data word can be separated into two 3 bit pulses and a 4 bit pulse for even less data (17 pulse start/end times). However, this would require faster LC response or would reduce the total pulse time and corresponding illumination. Likewise the 10 bit data word can be separated in two 3 bit pulses and two 2 bit pulses for 16 pulse start/end times. Furthermore, the 10 bit data word can be separated into five 2 bit pulses for just 15 pulse start/end times. The above is not a complete list of multiple pulse combinations. Other pulse combinations are possible.

With two or three pulse width modulated pulses per frame, the LC response does not need to be as fast as would be required for a monotonic DFM driving method. Due to a reduction in the number of pulses, a slower LC response could be accommodated.

Due to the need for monotonic behavior, the pulse width modulated pulses need to be separated allowing for LC turn-off. With two pulse width modulated pulses, there are two sets of rise and fall times affecting the gray scale response. While the response may not be linear if the rise and fall times are different, the response will be monotonic.

In FIG. 1, timing diagram 100 depicts MPWM having two pulses within a display frame period. The illumination is assumed to be constant. Display frame period 101 consist of a first pulse-width period 102, a second pulse-width period 103, a first pulse-off period 104 and a second pulse-off period 105. A first pulse-width period 102 and a second pulse width period 103 each consist of 5 pixel data bits encoded centered about first pulse-width center 106 and second pulse-width center 107, respectively. There is a first subgroup and a second subgroup of decoded data time periods before and after a pulse-width center, respectively. Data weights are described here as least significant bit (LSB) to most significant bit (MSB) with digits added and subtracted to span the binary weighted bit range. Relative bit weights are noted within a left and right parenthesis below.

In timing diagram 100, it is not possible to depict the time weights of the binary weight data times since the range between the MSB bit and the LSB bit is 512:1. LSB (1) time 108, MSB (512) time 117, LSB+3 (8) time 111, LSB+4 (16) time 112 and MSB−4 (32) time 113 are binary weighted in time relative to first pulse-width center 106. Similarly, LSB+1 (2) time 109, MSB−1 (256) time 116, LSB+2 (4) time 110, MSB−3 (64) time 114 and MSB−2 (128) time 115 are binary weighted in time relative to second pulse-width center 107.

In the first subgroup of first pulse-width period 102, a first pulse is set high at the beginning of first pulse-width period 102 or LSB (1) time 108 or MSB (512) time 117 or pulse width center 106. The beginning of first pulse period 102 is high if both LSB (1) bit and MSB (512) are high. A second subgroup of first pulse-width period 102 is set low at pulse-width center 106 or LSB+3 (8) time 111 or LSB+4 (16) time 112 or MSB−4 (32) time 113. The end of first pulse-width period 102 is a time when a first pulse is set low if the LSB+3 bit, LSB+4 bit and the MSB−4 bit are all high. The other unlabeled periods in the second subgroup correspond to the other three on-bit combination of the LSB+3, LSB+4 and the MSB−4 bits.

In the first subgroup of second pulse-width period 103, a second pulse may be set high at the beginning of second pulse-width period 103 or LSB+1 (2) time 109 or MSB−1 (256) time 116 or pulse-width center 107. The beginning of second pulse-width period 103 is set high if both LSB (1) bit and MSB (512) are high. A second subgroup of second pulse period 103 is set low at pulse-width center 107 or LSB+2 (4) time 110 or MSB−3 (64) time 114 or MSB−2 (128) time 115. The end of second pulse period 103 is a time when a second pulse is set low if the LSB+2 bit, MSB−3 bit and the MSB−2 bit are all high. The other unlabeled periods in the second subgroup correspond to other three on bit combination of the LSB+2, MSB−2 and the MSB−2 bits.

The encoded bit weighted timing positions in FIG. 1 were chosen to reduce the average data rate to pixel array. It should be noted that there many other possible bit weighted timing position arrangements.

Figure 2:
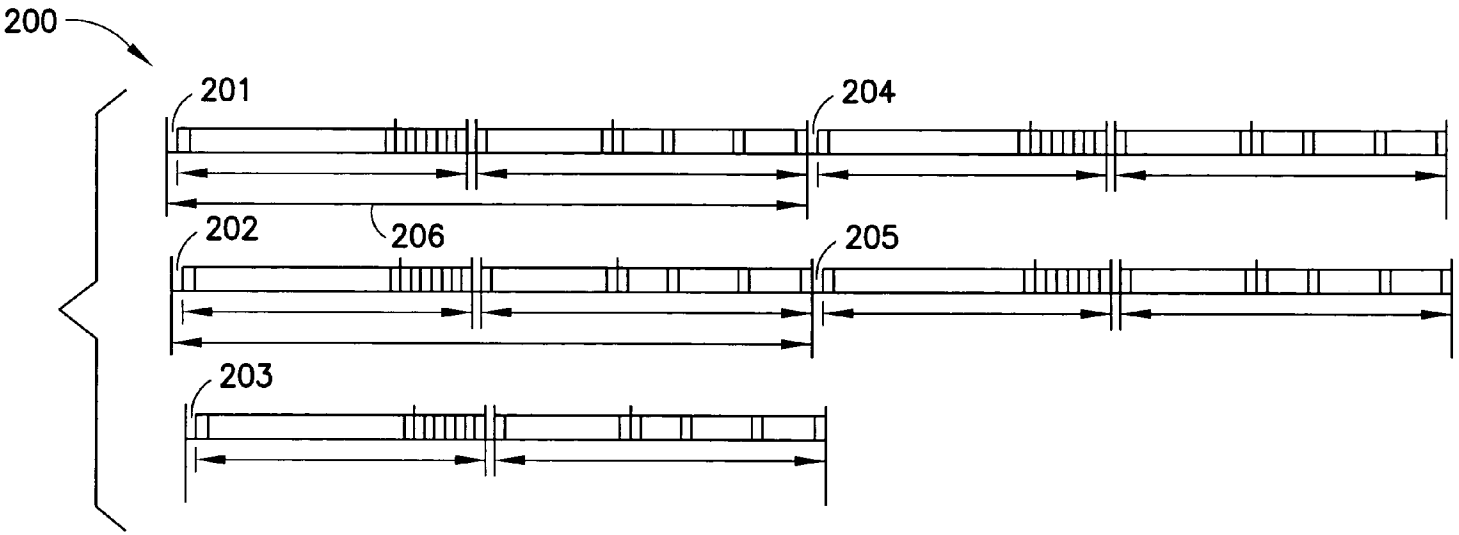
FIG. 2 is a timing diagram similar to FIG. 1 but showing timing for pixel electrode data uploaded one row at a time in a first and second frame.

FIG. 2 shows row electrode timing for a continuous illumination display system in which the new pixel electrode data are updated one row at a time. Timing diagram 200 shows timing diagram 100 repeated as first frame first row timing 201, first frame second row timing 202, first frame last row timing 203, second frame first row timing 204 and second frame second row timing 205. First frame second row timing 202 and second frame second row timing 205 are slightly delayed from first frame first row timing 201 and second frame first row timing 204, respectively. The rows correspond to the first, second and last row in the pixel array. The delay of first frame last row timing 203 relative to first frame first row timing 201 is shown as being delayed somewhat after the first frame second row timing 202.

With random row access row driving it possible for the delay of the last row timing 203 relative to the beginning of the frame to be almost an entire frame time. The frame time is shown as frame period 206. Such delay would cause first frame last row timing to substantially overlap the second frame first row timing 204. Depending upon the frame rate such extreme delays may not be desirable.

With constant illumination and 10 bit gray scale data, the time difference for exposing a MSB portion and LSB is 512 to 1. This implies that there is very little time to present the LSB pulse increment before presenting the next bit pulse increment data. In general, this implies that very high date rates or bandwidth is still needed. This requirement can be somewhat reduced by the techniques detailed below.

For non color sequential systems with constant illumination, the data can be presented to the row pixel electrodes in a sequential manner as with top to bottom row scanning as depicted in FIG. 2. It should be noted that random access row addressing can be helpful for reducing the array data rates to the display pixel array.

Alternatively, pixel data can be presented to all the array pixel electrodes simultaneously, known as global updating, if the pixel circuit contains two data storage nodes. This feature is generally necessary for color sequential operation or amplitude varying illumination or pulsed illumination. Pulsed or amplitude varying illumination can also help to reduce the array data bandwidth requirement.

Figure 3:
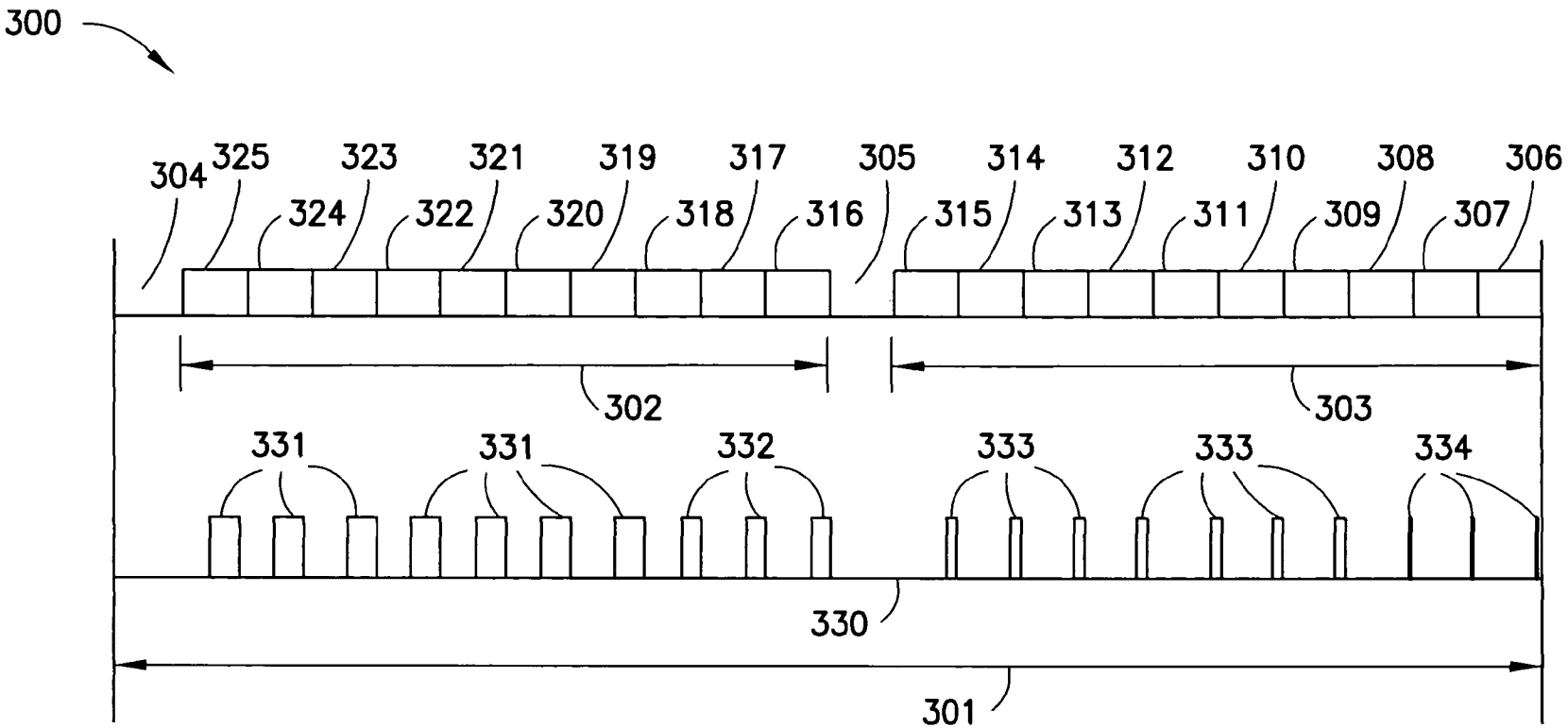
FIG. 3 is a timing diagram similar to FIG. 1, but additionally showing illumination pulses modulated by pulse width, constrained to only four unique pulse widths but enabling a gray scale of 512:1.

While illumination is typically constant, with pulsed weighted illumination with very fast LC response, additional display controller and display backplane simplification can be realized. In FIG. 3 the timing diagram 300 shows a 10 bit double pulse LC driving method using pulsed illumination. Display frame period 301 consists of a first pulse-width period 302, a second pulse-width period 303, a first pulse-off period 304 and a second pulse-off period 305. A first pulse-width period 302 and a second pulse-width period 303 each consist of 5 data bits which are decoded into 10 bits of data with 10 equal duration time positions. The LSB (1) and LSB+1 (2) data bits are decoded into data time periods 306, 307 and 308 with reference to the beginning of data time period 308, the first pulse width center. The LSB+2 (4), LSB+3 (8) and LSB+4 (16) bits are decoded into data time periods 309, 310, 311, 312, 313, 314 and 315 with reference to the end of data time period 309, the first pulse width center. MSB−4 (32) and MSB−3 (64) bits are decoded into data time period 316, 317 and 318 relative to the beginning of data time period 318, the second pulse width center. MSB−2 (128), MSB−1 (256) and MSB (512) bits are decoded into data time periods 319, 320, 321, 322, 323, 324 and 325 with reference to the end of data time period 319, the second pulse width center. The equal length of the data time periods reduces the display data rates.

Illumination pulse timing 330 consists of four pulse groups 331, 332, 333 and 334 each having different pulse widths. The illumination levels 331, 332, 333 and 334 have relative pulse widths of 128, 32, 4 and 1, respectively. Illumination level 331 in time corresponds to the MSB (512), MSB−1 (256) and MSB−2 (128) decoded data time periods 319, 320, 321, 322, 323, 324 and 325. Illumination level 332 corresponds to MSB−3 (64) and MSB−4 (32) decoded data time periods 316, 317 and 318. Illumination level 332 extends to the second pulse-off period 305. Illumination level 333 corresponds to LSB+2 (4), LSB+3 (8) and LSB+4 (16) decoded data time periods 309, 310, 311, 312, 313, 314 and 315. Illumination level 334 corresponds to the LSB (1) and LSB+1 (2) data decode time periods 306, 307 and 308. Illumination level 334 extends to the first pulse-off period 304 of the next frame period, not shown.

Timing diagram 300 significantly reduces the data bandwidth between the display controller and the display by more evenly spreading the data bits out over the frame period due to using illumination weighting as opposed to the use of time weighting in timing diagram 100 or 200. Each data bit is presented for approximately 1/22 of a frame period which is a much longer time than the LSB bit exposure in timing diagram 100 which is 1/1024 of a frame period.

In timing diagram 300, the reduction in bandwidth is obtained by requiring faster LC response than required by timing diagrams 100 and 200. In timing diagram 300, the response time must be less than 1/22 of a frame period. In timing diagrams 100 and 200, the fractional frame period time allowed for LC response is a display controller to display data bandwidth trade off; the LC response time must be much less than ½ the frame period.

In timing diagram 300, the data decode and illumination timing sequence need not be in the order depicted. For the two 5 bit decode pulses chosen, many different data decode and illumination timing and weighting arrangements are possible.

While timing diagram 300 shows fixed or equal duration data time periods, data time periods 306 through 325, the least significant bit data time periods can be shortened by the time not needed by the illumination to allow more time for the most significant bit time periods. In addition, the bit weighted illumination error allowable is approximately ½ the inverse of the bit weight. So less LC response time could be used for the lower bits and more LC response time could be used for the higher order bits. These techniques could allow for a slower LC response.

The luminance range of the pulses in illumination timing 330 is 128 to 1. With use of an optically addressed spatial light modulator OASLM whose integration period begins at the beginning of the first pulse in illumination timing 330, the pulse luminance range may be reduced from 128:1 to approximately 25:1. The OASLM integration property adds weight to the data presented early in the read valve frame period, thereby reducing the pulse luminance range required. Each of the 20 illumination pulses would have a different pulse width or amplitude due to the OASLM integration effects.

Figure 4:
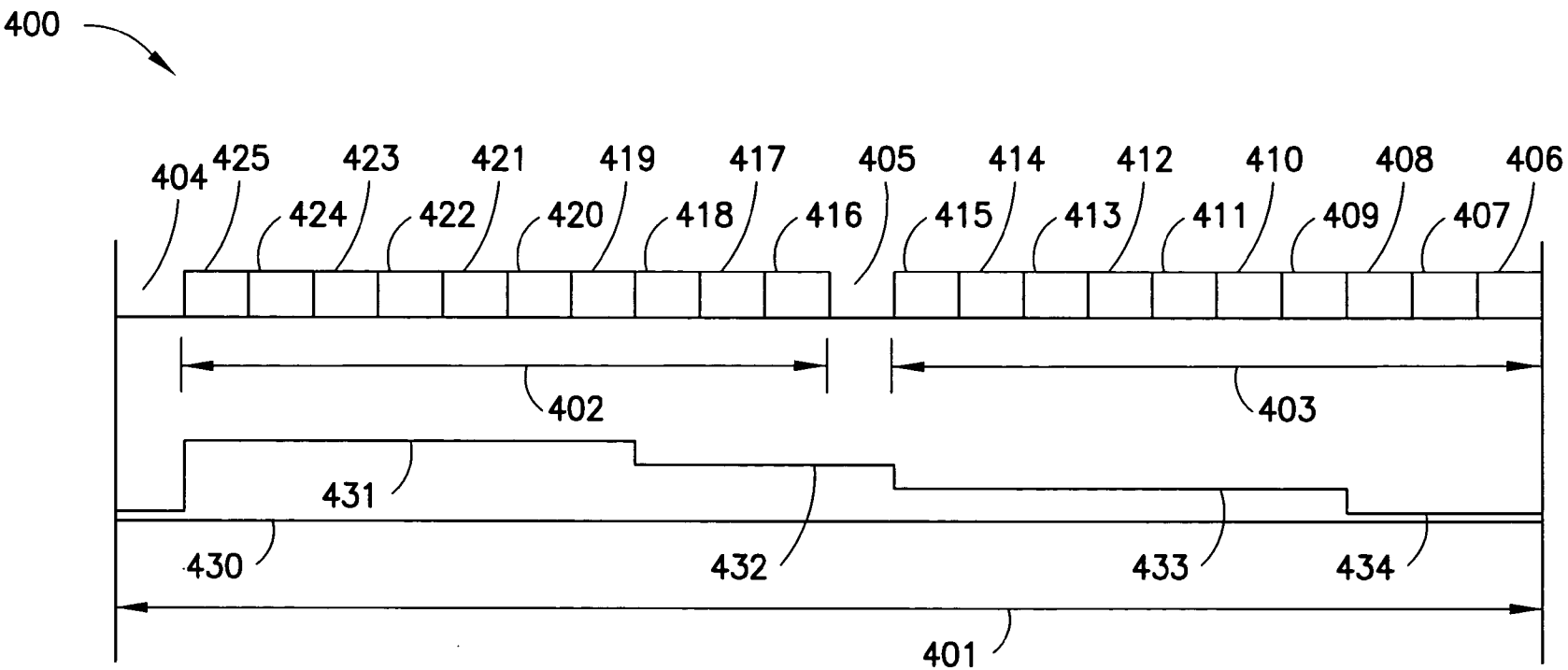
FIG. 4 is a timing diagram similar to FIG. 3 but alternatively showing illumination pulses modulated by illumination levels/amplitude.

Illumination sequence 330 shows that the illumination pulses that are shorter in duration for the least significant bits and longer for the most significant bits. Instead of weighted pulse duration, the amplitude of the illumination could vary. In FIG. 4 the timing diagram 400 shows a 10 bit double pulse LC driving method using amplitude varying illumination. Display frame period 401 consist of a first pulse-width period 402, a second pulse-width period 403, a first pulse-off period 404 and a second pulse-off period 405. A first pulse-width period 402 and a second pulse-width period 403 each consist of 5 data bits which are decoded into 10 bits of data and 10 equal duration time positions. The LSB (1) and LSB+1 (2) data bits are decoded into data time periods 406, 407 and 408 with reference to the beginning of data time period 408, the first pulse width center. The LSB+2 (4), LSB+3 (8) and LSB+4 (16) bits are decoded into data time periods 409, 410, 411, 412, 413, 414 and 415 with reference to the end of data time period 409, the first pulse width center. MSB−4 (32) and MSB−3 (64) bits are decoded into data time period 416, 417 and 418 relative to the beginning of data time period 418, the second pulse width center. MSB−2 (128), MSB−1 (256) and MSB (512) bits are decoded into data time periods 419, 420, 421, 422, 423, 424 and 425 with reference to the end of data time period 419, the second pulse width center. The equal length of the data time periods reduces the display data bandwidth.

Illumination pulse timing 430 consists of four different illumination amplitude levels 431, 432, 433 and 434. The illumination levels 431, 432, 433 and 434 have relative amplitudes of 128, 32, 4 and 1, respectively. Illumination level 431 in time corresponds to the MSB (512), MSB−1 (256) and MSB−2 (128) decoded data time periods 419, 420, 421, 422, 423, 424 and 425. Illumination level 432 corresponds to MSB−3 (64) and MSB−4 (32) decoded data time periods 416, 417 and 418. Illumination level 432 extends to the second pulse-off period 405. Illumination level 433 corresponds to LSB+2 (4), LSB+3 (8) and LSB+4 (16) decoded data time periods 409, 410, 411, 412, 413, 414 and 415. Illumination level 434 corresponds to the LSB (1) and LSB+1 (2) data decode time periods 406, 407 and 408. Illumination level 434 extends to the first pulse-off period of next frame period not shown.

One apparent advantage of using amplitude varying illumination is the LC response time would not need to be as fast as using pulsed illumination. However, the LC response may need to be faster than for constant illumination. On the other hand, the array data rate is as low as possible for this driving method.

If the display drivers are designed to simultaneously turn off the pixels in the array via an additional external signal, then the data required for turning off the LC between the two pulse width modulated pulses can be eliminated in the decoding process. This feature would allow an additional 10% reduction in memory and average data rate to the array.

The embodiments can be applied to other display devices having differences in turn on and turn off times such as organic light emitting diodes (OLEDs) or perhaps even digital micromirror devices (DMDs). In addition to displays, the data rate and memory system simplification can also be important to printer systems. MPWM may be useful in other applications as well.

Figure 5:
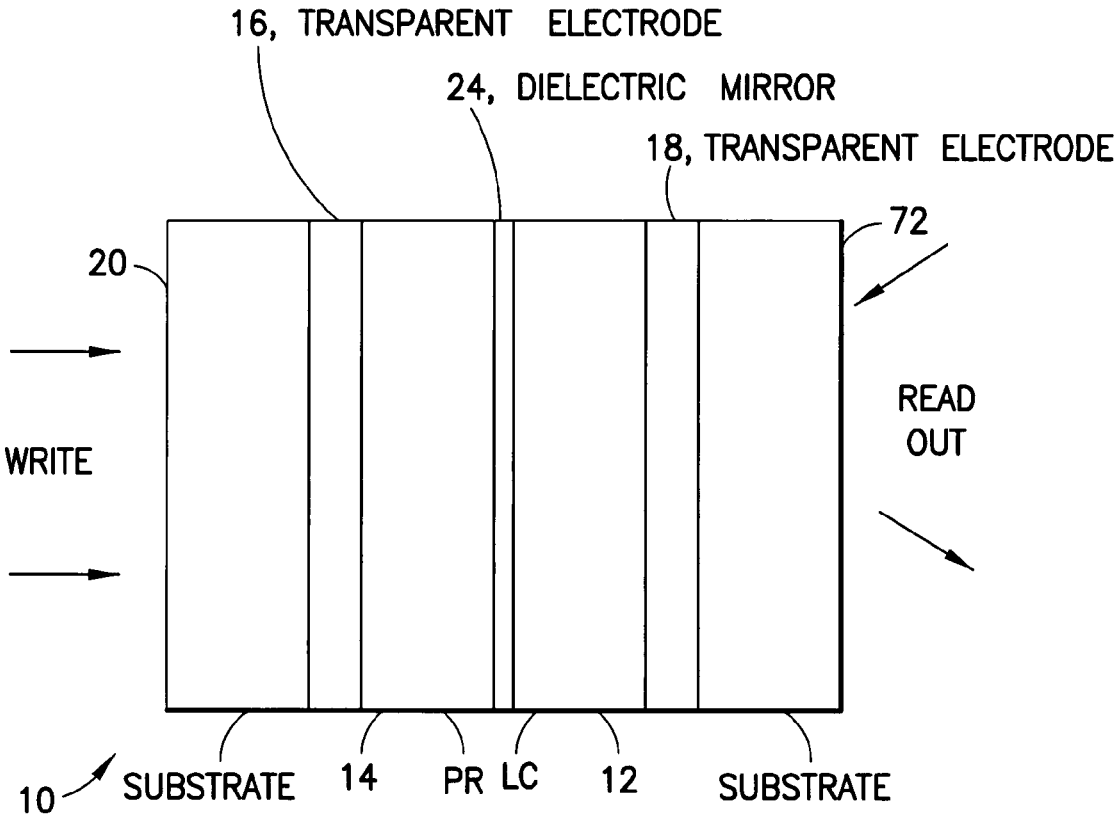
FIG.5 PRIOR ART
FIG. 5 is a diagram of a prior art optically addressed spatial light modulator that includes an electro-optic material layer and a photosensitive semiconductor material layer.

As noted above, the approach detailed herein is particularly advantageous for use in addressing an optically addressed spatial light modulator OASLM. FIG. 5 is a diagram of a currently available reflective OASLM 10 as detailed in the incorporated reference "An optically addressed gray scale electric charge accumulating spatial light modulator," U.S. Provisional Application No. 60/803,747. The OASLM 10 includes an electro-optic material (e.g., liquid crystal) layer 12 and a photoconductive layer 14 formed usually of semiconductor material. The semiconductor materials in this example were selected from a variety of materials absorbing light in the visible wavelength range (400 nm-700 nm), for example, amorphous silicon, amorphous silicon carbide, single crystal $Bi_{12}SiO_{20}$, silicon, GaAs, ZnS, and CdS. Liquid crystal layer 12 and photosensitive layer 14 are positioned between optically transparent electrodes 16 and 18 supported on respective substrates 20 and 22. The visible output light (read light) is reflected off a dielectric mirror 24. In the transmission mode, both the write light and the read light passes through substrate 20 and there is no dielectric mirror 24 and the photoconductive layer 14 must absorb the write light and pass the read light.

Pixel data modulated into frames and pulse width periods as detailed above may be used as the write light, by which a gray-scale modulated image is written to the OASLM 10 and thereafter read out by the read light.

Figure 6:
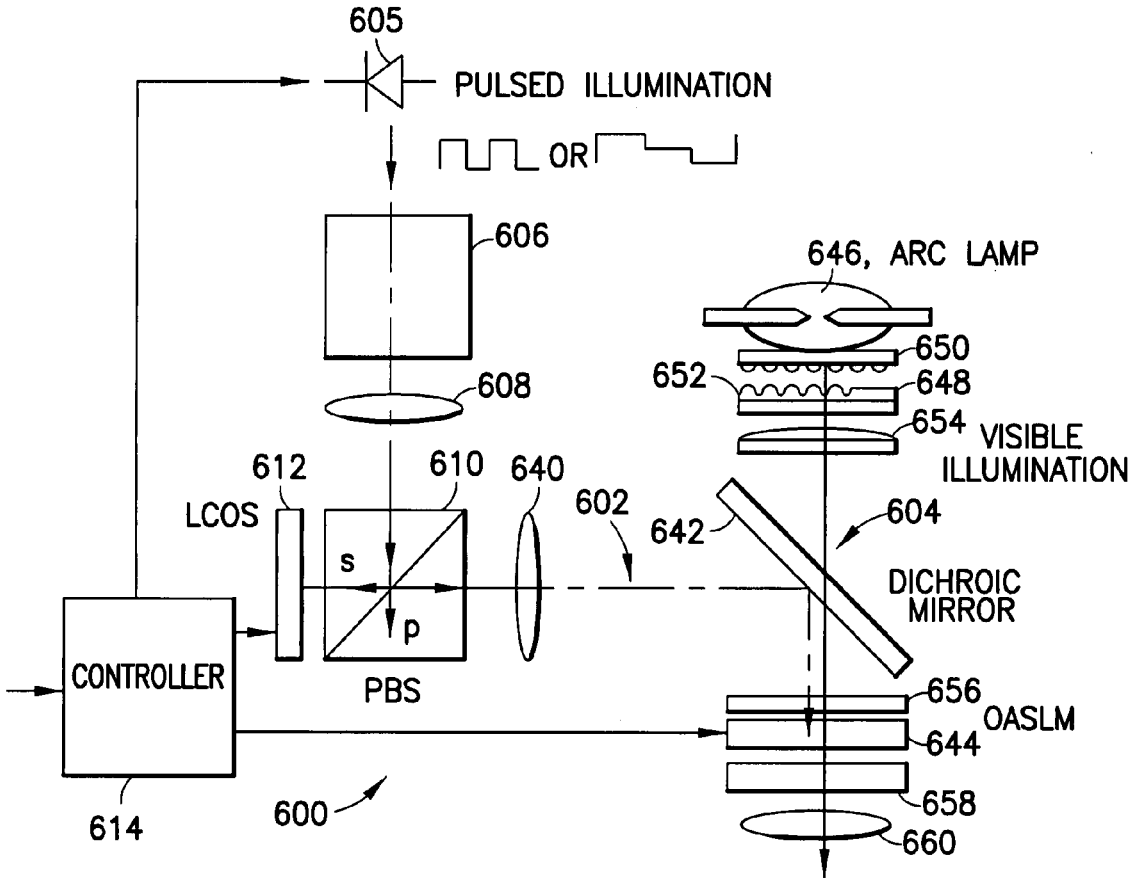
FIG. 6 is a simplified block diagram of an optically addressed spatial light modulator system in which digital modulation is carried out to achieve a light output characterized by substantially monotonic gray scale response.

A more particular embodiment of an overall system using the frames and pulse width periods within an overall system detailed in the incorporated reference U.S. Provisional Application No. 60/803,747 is shown at FIG. 6. This diagram is a simplified block diagram of an OASLM system 600 in which digital modulation is carried out to achieve a light output characterized by substantially monotonic gray scale response. OASLM system 600 defines a write optical path 602 and a read optical path 604. Write optical path 602 is composed of a segment along which propagates an image definition beam. A UV LED 605 provides a pulsed UV write light beam source. The pulsed UV beam emitted from UV LED 605 propagates through a tunnel integrator 606, a relay lens group 608, and a polarizing beamsplitter 610 to provide uniform, rectangular illumination that matches the image aspect ratio of an LCOS microdisplay device 612. The p-polarization of the illumination passes through the polarizing beam splitter 610. The s-polarization of the illumination is reflected by the polarizing beam splitter 610 onto the LCOS device 612. Light controlling signals are provided to UV LED 605 by a controller 614.

LCOS device 612 provides, in response to image data delivered to LCOS device 612 by controller 614, UV write light patterns for a selected color component of the primary colors (RGB). The modulated illumination reflected back from the LCOS device 612 propagates back into the polarizing beam splitter. The p polarization of the reflected modulated illumination passes through the polarizing beam splitter and it is imaged by an imaging lens 640 and reflects off a tilted dichroic mirror 642 for incidence on an OASLM 644. OASLM 644 is preferably of the type described at FIG. 5 or similar thereto, and also seen at FIGS. 1-3, 4A and 4B of International Application No. PCT/US2005/018305. The modulated light incident on the photoconductor layer of OASLM 644 develops a voltage across its liquid crystal layer. This voltage causes a director field orientation that corresponds to the integrated intensity of the associated incident UV write light beam. Controller 614 provides a voltage signal to OASLM 644 to enable it to develop the liquid crystal voltage in proper timing relationship with the incidence of the UV write light.

Read optical path 604 includes an arc lamp 646, which emits randomly polarized white light. The white light propagates through a polarization converter 648, formed as an integral part of an assembly of fly's-eye lenslet arrays 650 and 652, and thereafter through a focusing lens 654 and a linear polarizer 656 to provide linearly polarized light in the form of uniform, rectangular illumination that matches the image aspect ratio of read valve OASLM 644. Tilted dichroic mirror 642 separates the white light into the selected primary color light component and directs these through field lenses (not shown) to read valve OASLM 644. Depending on the image defined by the UV write light beam, the color light component is either transmitted through or absorbed by an analyzer 658 positioned in proximity to read valve OASLM 644, resulting in intensity modulation of the corresponding color image content. The modulated light beam propagating through read valve OASLM 644 is directed through a projection lens 660 to generate a color image for projection on a display screen (not shown).

Controller 614 coordinates the digital modulation of LCOS device 612 in accordance with the image plane data, the timing of pulsed light emissions from UV LED 605, and the analog modulation control of read valve OASLM 644 to produce visible analog modulated output illumination having a substantially monotonic gray scale response. The phrase 'substantially monotonic' is used to mean that there is or almost is a monotonic gray level response. With digital driving methods, 8 bit pixel data is used in a table lookup to create 10 bits of data. The additional 2 bits of data are used to account for various nonlinearities such as the nonlinear electro optic properties of liquid crystal. For example, it may be visually acceptable that the 10 bit data transfer function be monotonic for the 8 most significant bits. However those 10 bits of pixel data are achieved, they are mapped and modulated in the frame as detailed above.

In an OASLM, the voltage across the photoreceptor/liquid crystal assembly reverses polarity at the end of each frame. When voltage polarity reversal occurs, the integrated charge built up in the liquid crystal is neutralized, thereby eliminating the previous photo-induced voltage across the liquid crystal layer. Thus, liquid crystal voltage integration restarts from zero at the beginning of each frame. Voltages produced by the integration of charge in the photoreceptor influence, therefore, only the liquid crystal layer from the time they are produced until the end of the frame. Voltages produced early in the frame are effectively weighted more heavily than those produced near the end of the frame.

Now, the teachings of the pulse width/amplitude driving method detailed above are in conjunction with the integration at the LC of the OASLM. The frame structure into which the bits are modulated does not alter the bit weighting of the continuous integration at the LC of the OASLM. An important advantage of the frame structure is to enable a more precise response from the write valve given rise and fall times at the electro optical layer of the LCoS/write valve. The pulse width/amplitude driving frame structure need not be used with the bit weighting by frame time, but it is one particularly synergistic embodiment.

Figure 7:
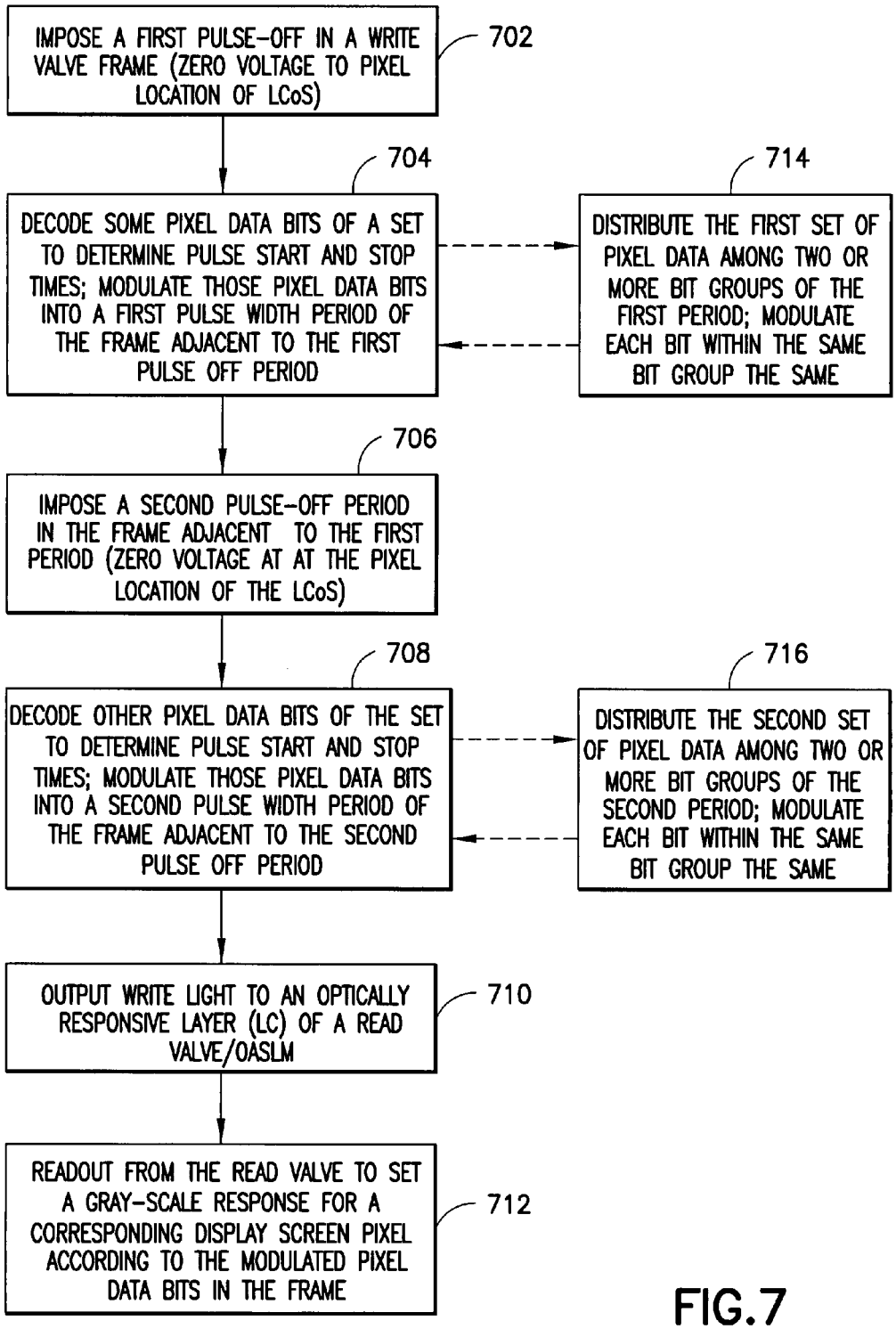
FIG. 7 is a flow diagram outlining method steps in accordance with an exemplary embodiment of the invention

The approach of the frame structure is shown in summary at FIG. 7, which applies for each pixel location and in each of multiple consecutive frames of a video or otherwise digitally refreshed display. As block 702, a first pulse-off period is imposed in a frame as seen at FIG. 1 for example. Some of the pixel data bits of the set are decoded in order to find the actual pulse start and stop times in the first pulse width period (5 selected bits for the example above where 5 bits are modulated into each of two pulse width periods of a frame), and those decoded bits are modulated into a first pulse width period of the same frame at block 704, where the first pulse width period is adjacent in time to the first pulse-off period. A second pulse-off period is then imposed adjacent to the first pulse width period at block 706, and other pixel data bits of the set are modulated into a second period at block 708 similar to that done at block 704. The second pulse width period ends with the end of the frame. It is clear that the periods in which data is modulated may be moved in the frame such that the frame begins with a data period and terminates with a pulse-off period. Further, more than two such periods (data period and pulse-off periods) may be imposed; two have been illustrated in detail for clarity and not as a limitation.

Notable is that the pulse-off periods at blocks 702 and 704 need not be imposed by zeroing the voltage applied to the pixel location of the electro-optic (LC) layer of the LCoS. Instead, dropping the voltage there to a non-zero value just below a threshold turn-on voltage of that electro-optic layer for the duration of the pulse-off periods enables the LC layer to respond with improved speed as compared to a true zeroing of the voltage, and also provides a sufficient voltage swing in the LC drive electronics for proper operation.

The full set of pixel data for that pixel location of the LCoS is now modulated across both pulse width periods of the frame, and after synchronously illuminating the electro-optic layer of the LCoS with the similarly modulated light source, the write light is output at block 710 to a pixel location of an optically responsive layer of a read valve, such as the LC of an OASLM. Note that the write light is output as the bits are modulated and the LCoS is illuminated by the light source, so block 710 is continuous across blocks 704 and 708 and not a batch output after those latter two blocks are completed. The read valve is then read-out at block 712 (also continuously across the frame), and the display screen pixel that corresponds to that pixel location of the read valve exhibits the gray scale response that was originally modulated at the write valve by the pixel data bits. The OASLM read valve or microdisplay itself, is reversed in polarity (momentarily 'turned off') between the frames as noted above, but this is generally not within the typical response time of the LC of the OASLM which displays as essentially an averaged light level. During the pulse off period within the frame, the display screen holds the voltage and thus the modulation value reached during the first pulse width period. Thus during a single frame, the display screen is illuminated to varying gray scale levels but the transitions from one frame to the next are not apparent to an observer.

As detailed above, the bits of each frame period may be further parsed into bit-groups, wherein each bit of a bit group is modulated with the same pulse width or illumination level as every other bit within the same bit group. These are shown by dashed arrows at blocks 714 and 716, and is the technique by which the ten bits of the examples were modulated in only four pulse widths (FIG. 3) or illumination levels (FIG. 4). Also as detailed with respect to those Figures, there may be a different number of bits (e.g., 2 and 3) in the different bit groups of a single period of a frame, and still a same number of bits (e.g., 5) may be modulated into the two different periods of the frame. As seen at FIG. 1, both the most significant bit and the least significant bit of the entire frame may lie within the same subgroup/bit group of the same pulse width period of the frame. Alternatively at FIGS. 3-4, all bits in the first period may be more significant than any bit of the second period. Each of the bits may be modulated into a time duration of the frame that is constant across all of the bits, even though PWM might be used so that some modulated bits occupy more of that time duration than other less significant bits.

The embodiments of this invention may be implemented by computer software executable by a data processor such as the controller 614 shown, or by hardware circuitry, or by a combination of software and hardware circuitry. Further in this regard it should be noted that the various blocks of the logic flow diagram of FIG. 7 may represent program steps, or interconnected logic circuits, blocks and functions, or a combination of program steps and logic circuits, blocks and functions for performing the specified tasks.

Clearly these general teachings should be interpreted to include reasonable variations on this concept, including different ways of parsing the frame according to the general concepts shown herein and of assigning bits to different partitions of the frame. Several variations are disclosed, but that is not to imply the extent of the invention but rather a teaching of the inventive concept to those skilled in the art. Different numbers of gray scale bits that are modulated in a frame, different partitions of the pulse width periods within a frame, different length pulse-off periods within a same frame, different weight levels/subgroups within a pulse width period, and other variations are not detailed herein by specific example but still clearly within the scope of these teachings. Although described in the context of particular embodiments, it will be apparent to those skilled in the art that a number of modifications and various changes to these teachings may occur. Certain modifications or changes may be made therein without departing from the scope and spirit of the invention as set forth above, or from the scope of the ensuing claims.

We claim:

1. A method comprising:

for a plurality of pixel locations of an electro-optic layer of an optical write valve and across each of a plurality of consecutive frames:

modulating a set of pixel data bits across a first and a second pulse width period of the frame, wherein the first and second pulse width periods, and adjacent pulse periods of sequential frames, are separated from one another by a pulse-off period that is at least equal to a response time of the electro-optic layer during which no bits are modulated; and separately in each frame, outputting write light from each of the plurality of pixel locations according to the modulated pixel data bits in the frame.

2. The method of claim 1, wherein modulating the set of pixel data bits comprises applying a voltage in synchronism with illuminating a light source.

3. The method of claim 2, wherein applying the voltage in synchronism with illuminating the light source comprises, for each of the pixel data bits, applying a voltage to a pixel location at a backplane of the electro-optic layer and while the voltage is applied illuminating the pixel location with the light source modulated in at least one of time and amplitude.

4. The method of claim 3, wherein the voltage applied to the pixel location is adjusted to a value below a threshold turn-on voltage of the electro-optic layer for the duration of the pulse off periods.

5. The method of claim 1, wherein the response time comprises no overlap between voltage fall and rise times between pulses applied to the electro-optic layer.

6. The method of claim 1, wherein the first and second pulse width periods of the frame are not of equal length.

7. The method of claim 1, wherein for each frame, each of the pixel data bits of the set are modulated into discrete positions of the first and second pulse width periods, such that: at least two discrete positions of the first pulse width period represents a first bit weight;

at least two other discrete positions of the first pulse width period represent a second bit weight less than the first bit weight;

at least two discrete positions of the second pulse width period represents a third bit weight less than the second bit weight; and at least two other discrete positions of the second pulse width period represent a fourth bit weight less than the third bit weight.

8. The method of claim 1, wherein for each frame, each of the first and second pulse width periods are divided into equal duration data time periods during which one of the pixel bits is modulated.

9. The method of claim 1, wherein for each frame, each pixel data bit modulated into the first pulse width period represents a more significant bit than any pixel data bit modulated into the second pulse width period of the frame.

10. The method of claim 1, wherein for each frame, the set of pixel data bits comprises a set of gray scale bits and the output write light is a monotonic gray scale response.

11. The method of claim 1, wherein outputting write light further comprises directing the output write light to an optically responsive layer of an optical read valve and reading out the optically responsive layer to a display screen by globally updating pixels of the display screen simultaneously.

12. An optical write valve comprising:

an electro-optic layer;

a backplane defining pixel locations of the electro-optic layer;

a light source arranged in optical communication with the electro-optic layer;

a controller coupled to a memory and adapted to, for each pixel location and across each of a plurality of consecutive frames, to apply a voltage in synchronism with illuminating the light source so as to modulate a set of pixel data bits across a first and a second pulse width period of a frame, wherein the first and second pulse width periods and adjacent pulse periods of sequential frames, are separated from one another by a pulse-off period that is at least equal to a response time of the electro-optic layer during which no bits are modulated; and wherein the electro-optical layer is adapted, separately in each frame, to output write light from each of the pixel locations according to the modulated pixel data bits in the frame.

13. The optical write valve of claim 12, wherein the controller is adapted to apply the voltage in synchronism with illuminating the light source by, for each of the pixel data bits, applying a voltage to a pixel location at a backplane of the electro-optic layer and while the voltage is applied to illuminate the pixel location with the light source modulated in at least one of time and amplitude.

14. The optical write valve of claim 13, wherein the controller is adapted to adjust the voltage applied to the pixel location to a value below a threshold turn-on voltage of the electro-optic layer for the duration of the pulse off periods.

15. The optical write valve of claim 12, wherein the response time comprises no overlap between voltage fall and rise times between pulses applied to the electro-optic layer.

16. The optical write valve of claim 12, wherein the first and second pulse width periods of the frame are not of equal length.

17. The optical write valve of claim 12, wherein for each frame, each of the pixel data bits of the set are modulated into discrete positions of the first and second pulse width periods, such that:

at least two discrete positions of the first pulse width period represents a first bit weight;

at least two other discrete positions of the first pulse width period represent a second bit weight less than the first bit weight;

at least two discrete positions of the second pulse width period represents a third bit weight less than the second bit weight; and at least two other discrete positions of the second pulse width period represent a fourth bit weight less than the third bit weight.

18. The optical write valve of claim 12, wherein for each frame, each of the first and second pulse width periods are divided into equal duration data time periods during which one of the pixel bits is modulated.

19. The optical write valve of claim 12, wherein for each frame, each pixel data bit modulated into the first pulse width period represents a more significant bit than any pixel data bit modulated into the second pulse width period of the frame.

20. The optical write valve of claim 12, wherein for each frame, the set of pixel data bits comprises a set of gray scale bits and the output write light is a monotonic gray scale response.

21. The optical write valve of claim 12, further comprising an optically responsive layer of an optical read valve in optical communication with the output write light and a display screen optically coupled to the optically responsive layer adapted to globally update pixels of the display screen simultaneously.

22. A computer program embodied on a memory and readable by a computer for performing actions directed to outputting write light, the actions comprising, for a plurality of pixel locations of an electro-optic layer of an optical write valve and across each of a plurality of consecutive frames:

modulating a set of pixel data bits across a first and a second pulse width period of the frame, wherein the first and second pulse width periods, and adjacent pulse periods of sequential frames, are separated from one another by a pulse-off period that is at least equal to a response time of the electro-optic layer during which no bits are modulated; and separately in each frame, outputting write light from each of the plurality of pixel locations according to the modulated pixel data bits in the frame.

23. The computer program of claim 22, wherein modulating the set of pixel data bits comprises applying a voltage in synchronism with illuminating a light source.

24. The computer program of claim 23, wherein applying the voltage in synchronism with illuminating the light source comprises, for each of the pixel data bits, applying a voltage to a pixel location at a backplane of the electro-optic layer and while the voltage is applied illuminating the pixel location with the light source modulated in at least one of time and amplitude.

25. The computer program of claim 24, wherein the voltage applied to the pixel location is adjusted to a value below a threshold turn-on voltage of the electro-optic layer for the duration of the pulse off periods.

26. The computer program of claim 22, wherein the response time comprises no overlap between voltage fall and rise times between pulses applied to the electro-optic layer.

27. The computer program of claim 22, wherein the first and second pulse width periods of the frame are not of equal length.

28. The computer program of claim 22, wherein for each frame, each of the pixel data bits of the set are modulated into discrete positions of the first and second pulse width periods, such that:

at least two discrete positions of the first pulse width period represents a first bit weight;

at least two other discrete positions of the first pulse width period represent a second bit weight less than the first bit weight;

at least two discrete positions of the second pulse width period represents a third bit weight less than the second bit weight; and at least two other discrete positions of the second pulse width period represent a fourth bit weight less than the third bit weight.

29. The computer program of claim 22, wherein for each frame, each of the first and second pulse width periods are divided into equal duration data time periods during which one of the pixel bits is modulated.

30. The computer program of claim 22, wherein for each frame, each pixel data bit modulated into the first pulse width period represents a more significant bit than any pixel data bit modulated into the second pulse width period of the frame.

31. The computer program of claim 22, wherein for each frame, the set of pixel data bits comprises a set of gray scale bits and the output write light is a monotonic gray scale response.

32. The computer program of claim 22, wherein outputting write light further comprises directing the output write light to an optically responsive layer of an optical read valve and reading out the optically responsive layer to a display screen by globally updating pixels of the display screen simultaneously.

* * * * *